US011067261B2

(12) United States Patent
Kim

(10) Patent No.: US 11,067,261 B2
(45) Date of Patent: Jul. 20, 2021

(54) SIDE MOLDED COMBINATION TYPE LINE LIGHTS AND METHOD OF INTERIOR LIGHTING CONSTRUCTION USING THE SAME

(71) Applicant: SAM WHA TECH CO., Ltd, Ulsan (KR)

(72) Inventor: Cheol Woo Kim, Ulsan (KR)

(73) Assignee: SAMWHA TECH CO., LTD

( * ) Notice: Subject to any disclaimer, the term of this patent is extended or adjusted under 35 U.S.C. 154(b) by 0 days.

(21) Appl. No.: 16/550,436

(22) Filed: Aug. 26, 2019

(65) Prior Publication Data

US 2020/0072449 A1 Mar. 5, 2020

(30) Foreign Application Priority Data

Aug. 29, 2018 (KR) ..... 10-2018-0101683

(51) Int. Cl.
*F21V 21/02* (2006.01)
*F21V 3/00* (2015.01)
*F21W 131/405* (2006.01)

(52) U.S. Cl.
CPC ..... *F21V 21/025* (2013.01); *F21V 3/00* (2013.01); *F21W 2131/405* (2013.01)

(58) Field of Classification Search
CPC .... F21S 8/022; F21S 2/005; F21S 4/28; F21S 8/026; F21V 15/01; F21V 17/16; F21V 21/025
See application file for complete search history.

(56) References Cited

U.S. PATENT DOCUMENTS

2006/0262521 A1* 11/2006 Piepgras ..... E04B 9/006 362/149

* cited by examiner

*Primary Examiner* — Joseph L Williams
(74) *Attorney, Agent, or Firm* — Park & Associates IP Law, P.C.

(57) ABSTRACT

Side molded combination type line lights according to the present invention are configured to include: a fixed frame having a basic C-shaped cross sectional structure formed with a closing portion, opposite side walls, and an opening portion, wherein a protruding locking portion for guiding fixation of pieces is formed on each inner side of the opposite side walls, and a side mold coupling end is formed at each of the end portions of the opposite side walls; a diffusion plate coupled with the opening portion of the fixed frame; and a side mold formed in an L-shaped or T-shaped cross section, wherein an engaging portion to be coupled with the side mold coupling end is formed on one of the two types of side molds and coupled with each of the end portions of the opposite side walls of the fixed frame.

7 Claims, 12 Drawing Sheets

SIDE MOLDED COMBINATION TYPE LINE LIGHTS AND METHOD OF INTERIOR LIGHTING CONSTRUCTION USING THE SAME

REFERENCE TO RELATED APPLICATIONS

This application claims the priority benefit of Korean Patent Application No. 10-2018-0101683 filed on Aug. 29, 2018, the entire contents of which are incorporated herein by reference.

FIELD OF THE INVENTION

The present invention relates to side molded combination type line lights and a method of continuous interior lighting construction using the same and, more particularly, to side molded combination type line lights and a method of continuous interior lighting construction using the same, which solve a light leakage problem generated at the time of constructing line lights, thereby improving the aesthetics of an interior.

BACKGROUND OF THE INVENTION

Generally, in a store such as a department store, a large mart, a small mart, and the like handling various goods, a display space such as a display case, a display shelf, or the like, and aisle through which customers pass are necessary to be illuminated. However, in such an illuminated space, a large number of lighting lamps should be provided at regular distances, thereby causing a problem that an anchor, a hanger structure, and electric wires for supplying electric power are connected like a spider web.

In order to solve such a problem, a line lighting has been recently developed and widely used.

Related arts such as Korea Patent No. 101402092 'Line Type Illumination Device', Korea Patent No. 200485090 'Light Spreading Plate for Line Illumination System of Ceiling', and Korea Patent No. 101789744 'Line Typed Lighting for Ceiling Having Assembly Type Spread Lighting Plate in the Fixed Frame' introduce the technology of such a line light.

As illustrated in FIG. 16, a conventional line lights are formed such that a fixed frame 10' having a C-shaped cross section and made of metal such as aluminum in a large size on the installation surface is fixed and buried, and then an LED PCB is inserted as a light source into the fixed frame 10', and the diffusion plate 30' is coupled to the opening side.

However, in the case of line lights, since the lighting is continuously arranged in a large and long indoor space, there is a problem that a flatness inconsistency of the installation surface or a construction defect due to the standard length of the fixed frame occurs.

The problem of light leakage is most frequently encountered in such a problem. The problem of light leakage in line lights is the arrangement gap between the fixed frame and the diffusion plate or the arrangement gap due to the vertical clearance or the horizontal clearance generated in the construction. It is very likely that external defects will occur due to the fact that the countermeasures are carried out by a rule of thumb during the construction.

The light leakage problem between the fixed frame 10' and the diffusion plate 30' arises in a combination of problems such as the self-load of the plate 30' or a temperature rise. Accordingly, there is an urgent need to fix such a problem.

Hereinafter, the conventional art system will be described along with each of the fixed frame embodiments of the conventional art system illustrated in FIG. 16 and the constructional perspective view thereof.

FIG. 16 is a view illustrated for explaining the present invention, not an actual conventional fixed frame. Generally, opposite sides of the fixed frame are formed in a symmetrical structure, and the reason why the opposite sides are not symmetrical in FIG. 16 is that FIG. 16 is only illustrated for explanation by each part.

As illustrated in FIG. 16, in the conventional art, the fixed frame 10' is integrally assembled, thereby causing a problem that appearance of the interior is formed only by the fixed frame 10' or the diffusion plate 30'.

Accordingly, in the conventional art, there is no wing between end portions of opposite side walls of the fixed frame 10', or, when a small side wing 10'-2 is formed, the buried gap is exposed to the fixed frame 10' and the process appears to be incomplete.

Accordingly, in the fixed frame 10' of the conventional technique, the side wing 10'-1 to the same extent as the side mold illustrated in FIG. 13 is formed.

However, according to the conventional technique, since the size of the side wing varies according to the design standard applied to each construction site, there is a problem that the fixed frame 10' having various sizes should be produced.

That is, as illustrated in FIG. 16, when the side wing 10'-1 is integrally formed to the fixed frame 10', there is a problem that the supply of the material in the interior site is disrupted.

The foregoing is intended merely to aid in the understanding of the background of the present invention, and is not intended to mean that the present invention falls within the purview of the related art that is already known to those skilled in the art.

(Patent Document 1) Korea Patent No. 101402092, Line Type Illumination Device;

(Patent Document 2) Korea Patent No. 200485090, Light Spreading Plate for Line Illumination System of Ceiling; and (Patent Document 3) Korea Patent No. 101789744, Line-type lighting system for Ceiling Having Assembly Type Spread Lighting Plate in the Fixed Frame.

SUMMARY OF THE INVENTION

Accordingly, the present invention has been made keeping in mind the above problems occurring in the related art, and the present invention is intended to propose side molded combination type line lights and a method of continuous interior lighting construction using the same, which eliminate a light leakage problem of an arrangement gap between the fixed frame and the diffusion plate or a gap due to a vertical clearance or a horizontal clearance generated in the construction, thereby improving the aesthetics of an interior.

In order to achieve the above object, according to one aspect of the present invention, there is provided a side mold-coupled line typed lighting, the line lights including: a fixed frame having a basic C-shaped cross sectional structure formed with a closing portion, opposite side walls, and an opening portion, wherein a protruding locking portion for guiding fixation of pieces is formed on each inner side of the opposite side walls, and a side mold coupling end is formed at each of the end portions of the opposite side walls; a diffusion plate coupled with the opening portion of the fixed frame; and a side mold formed in an L-shaped or T-shaped cross section, wherein an engaging portion to be coupled with the side mold coupling end is formed on one of the two types of side molds and coupled with each of the end portions of the opposite side walls of the fixed frame.

Here, the side mold coupling end and the engaging portion may have male and female combination structures.

In addition, any male combination structure among the side mold coupling end and the coupling part may be formed in a U-shaped elastic coupling structure or an arrow-shaped elastic coupling structure and coupled inside the female combination structure, thereby elastically pressing the inner side of the female combination structure.

In addition, the T-shaped side mold coupling end may be characterized such that a vertical portion thereof becomes the engaging portion to be coupled with the side mold coupling end, and when the engaging portion is coupled with the side mold coupling end, a horizontal portion thereof covers a coupling gap between the diffusion plate and the fixed frame, thereby preventing light leakage and covers a gap between the fixed frame and a buried wall, thereby forming an aesthetic appearance.

In addition, the side mold coupling end and the engaging portion may be formed in a length where an insertion depth is adjustable, and protrusions capable of adjusting the insertion depth are mutually formed.

In addition, as a diffusion plate engaging portion is formed at the opening portion of the fixed frame, and the diffusion plate is engaged with the diffusion plate engaging portion, the side mold may be characterized to allow a light leakage to be prevented when the side mold is coupled with the fixed frame.

In addition, the side molded combination type line lights may further include an end mold having an H cross sectional structure formed with diffusion plate insertion grooves at opposite sides thereof symmetrically, wherein the end mold is inserted between end portions of adjacent fixed frames that are formed in a standard length and constructed and finishes a gap between the end portions of the adjacent fixed frames by inserting diffusion plates into the diffusion plate insertion grooves.

In addition, the side molded combination type line lights may further include a wall mold having an h cross sectional structure formed with a diffusion plate insertion groove at one side thereof, wherein the wall mold is inserted between end portion of a fixed frame constructed first from a wall and the wall and finishes a gap between the end portion of the fixed frame and the wall by inserting a diffusion plate into the diffusion plate insertion groove.

In addition, according to another aspect of the present invention, there is provided a method of continuous interior lighting construction of side molded combination type line lights, the method including: step 11 of coupling two fixed frames to be arranged in series while a vertical clearance 'b' is maintained when the vertical clearance 'b' (height difference) is generated between the two fixed frames arranged in series due to a flatness error of a construction surface; step 12 of covering an arrangement gap due to the vertical clearance 'b' of opening portions of the fixed frames by continuously coupling the diffusion plate of claim 1 with the two fixed frames; and step 13 of covering an arrangement gap due to the vertical clearance 'b' of two side walls of the two fixed frames by coupling the side molds of claim 1 with the fixed frames, whereby the vertical gap 'b' between the fixed frames is compensated to be horizontally viewed by a coupling depth adjusted, whereby the arrangement gap between the fixed frames due to the vertical clearance 'b' (height difference) of a construction surface is covered with the diffusion plate and the side mold.

In addition, a method of continuous interior lighting construction of side molded combination type line lights may include: step 21 of coupling two fixed frames to be arranged in series while a horizontal clearance 'a' is maintained when the horizontal clearance 'a' (length difference) is generated between the two fixed frames arranged in series due to a length of the fixed frames; step 22 of covering an arrangement gap due to the horizontal clearance 'a' of opening portions of the fixed frames by continuously coupling the diffusion plate of claim 1 with the two fixed frames; and step 23 of continuously coupling to cover an arrangement gap due to the horizontal clearance 'a' of two side walls of the two fixed frames by coupling the side mold of claim 1 with the two fixed frames, whereby the horizontal clearance 'a' due to a standard length of the fixed frames is covered with the diffusion plate and the side mold.

In addition, a method of continuous interior lighting construction of side molded combination type line lights may include: step 31 of coupling two fixed frames to be arranged in series while a linear clearance 'c' is maintained when the linear clearance 'c' is generated between the two fixed frames arranged in series due to a construction error; step 32 of covering an arrangement gap due to the horizontal clearance 'a' of opening portions of the fixed frames by continuously coupling the diffusion plate of claim 1 with the two fixed frames; and step 32 of covering an arrangement gap due to the horizontal clearance 'a' of opening portions of the fixed frames by continuously coupling the diffusion plate of claim 1 with the two fixed frames; and step 33 of covering an arrangement gap due to the linear clearance 'c' of two side walls of the two fixed frames by continuously coupling the side mold of the arrow-shaped elastic coupling structure with the two fixed frames, whereby the linear clearance 'c' due to a construction error of the fixed frames is covered with the diffusion plate and the side mold.

According to the present invention, there is an advantage that the side molded combination type line lights and a method of continuous interior lighting construction using the same, which eliminate the light leakage problem of the arrangement gap between the fixed frame and the diffusion plate or the arrangement gap due to the vertical clearance or the horizontal clearance generated in the construction, thereby improving the aesthetics of an interior.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, the present invention will be described with reference to the drawings. In the following description of the present invention, a detailed description of a related art or configuration will be omitted if it is determined that the gist of the present invention may be unnecessarily obfuscated thereby.

It is to be understood that the following terms are defined in consideration of functions in the present invention and can be changed according to the intention or the customs of a user or an operator. Accordingly, the definition thereof should be determined based on the contents throughout the specification for explaining the present invention.

Figure 1:
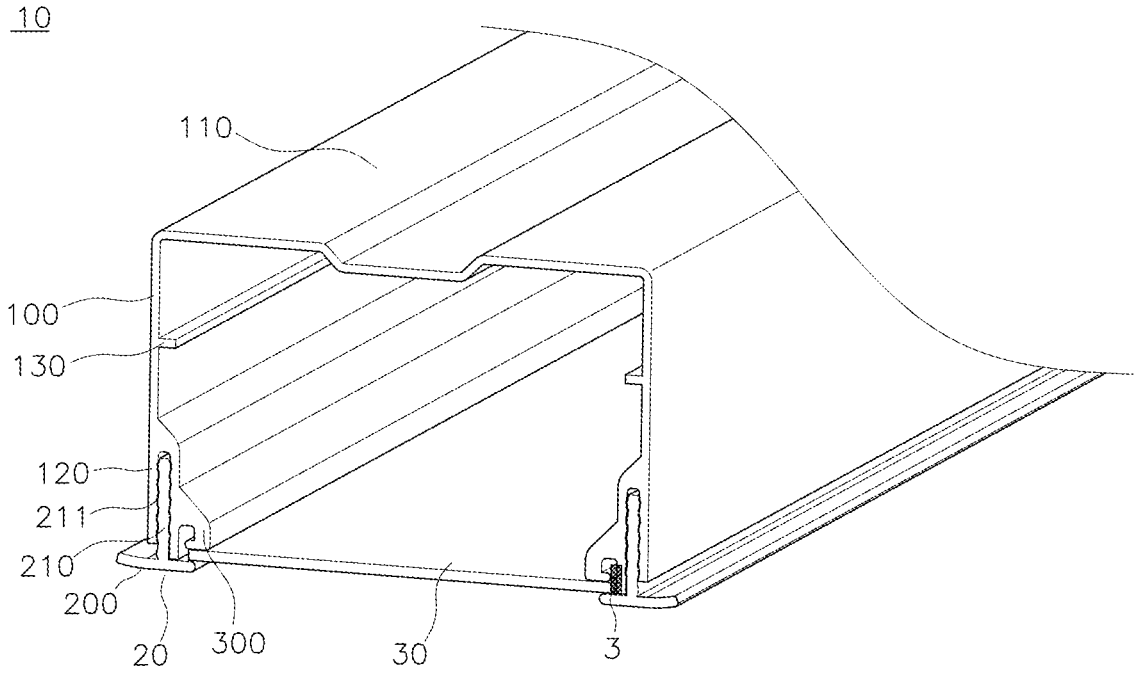
FIG. 1 is an assembled perspective view of an embodiment of the present invention.
Figure 2:
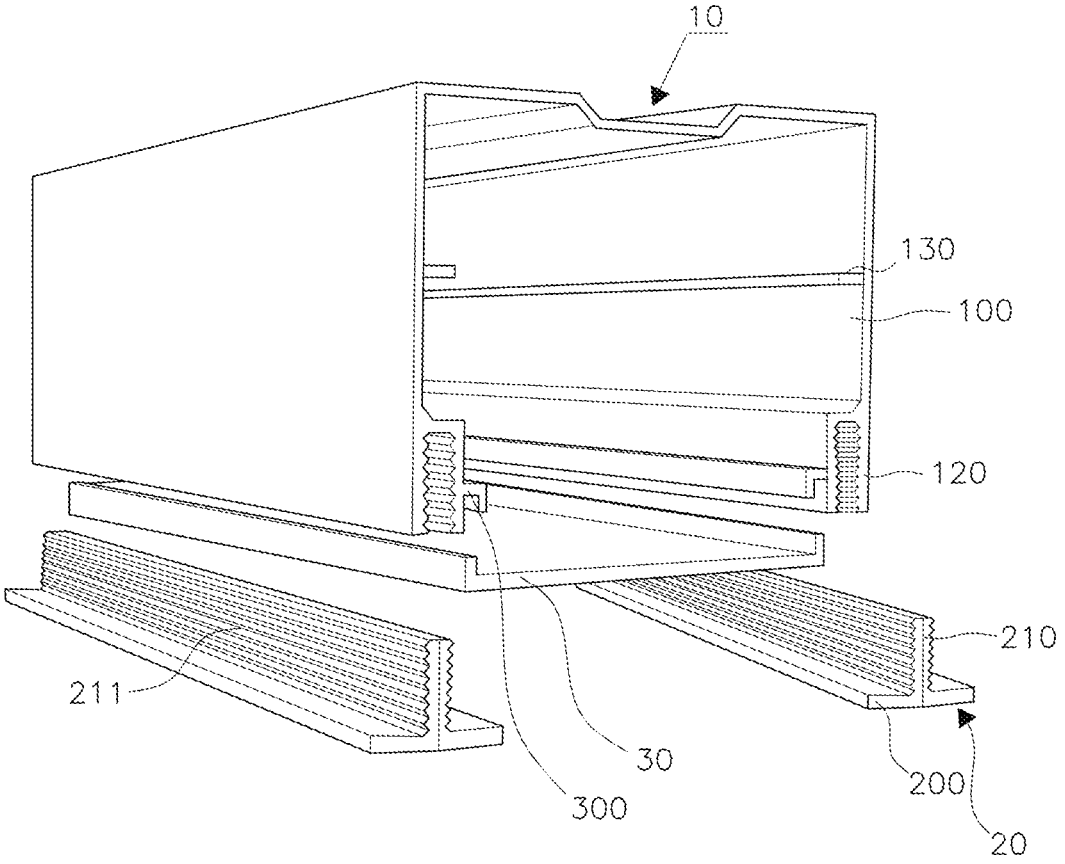
FIG. 2 is an exploded perspective view of an embodiment of the present invention.
Figure 3:
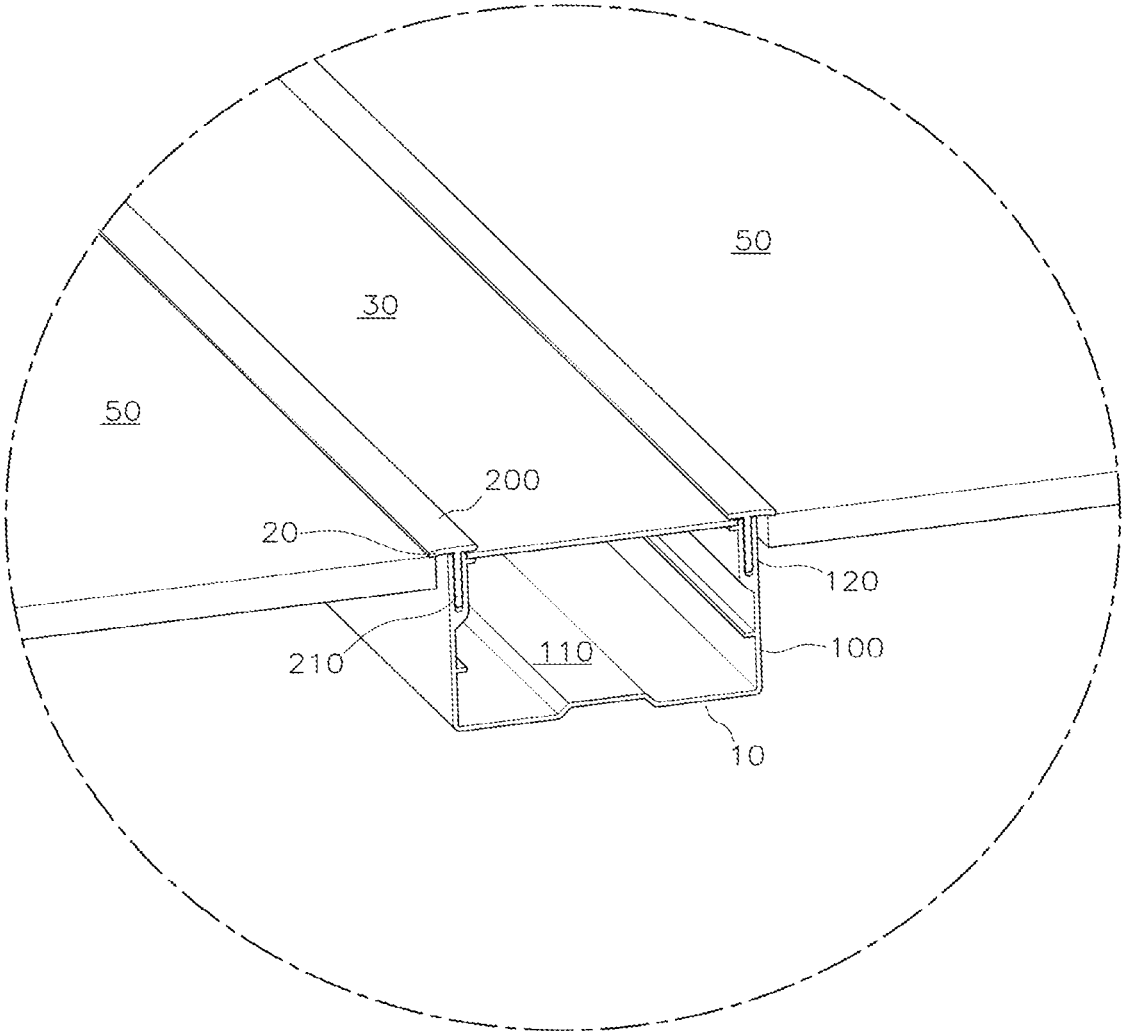
FIG. 3 is a perspective view of post construction of FIG. 2.
Figure 4A:
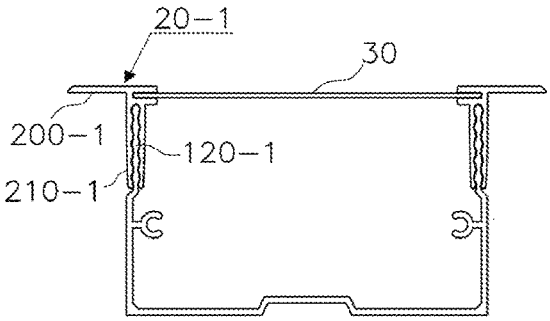
FIGS. 4A to 4G are each a cross sectional view of each embodiment of the present invention.
Figure 4B:
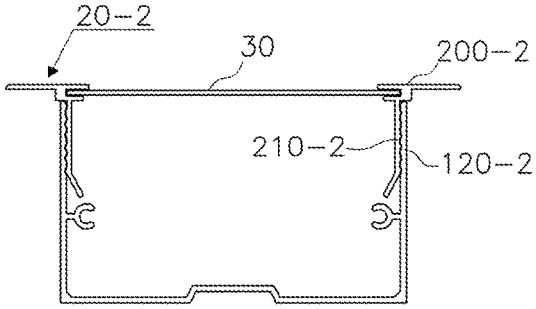
Figure 5:
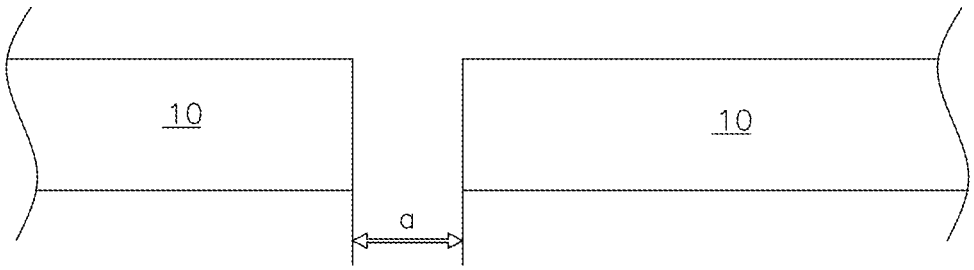
FIG. 5 is a side view illustrating a horizontal clearance of fixed frames generated in the construction of the fixed frames.
Figure 6:
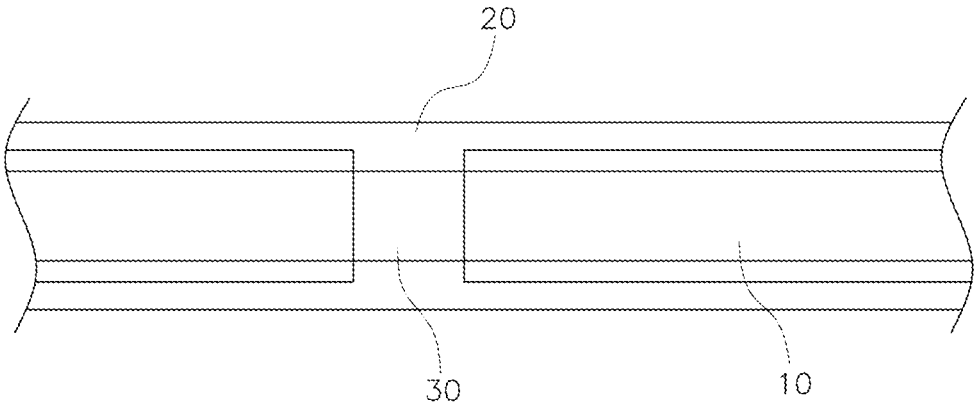
FIG. 6 is a plane view illustrating a concept of compensating a horizontal clearance of fixed frames according to the present invention.
Figure 7:
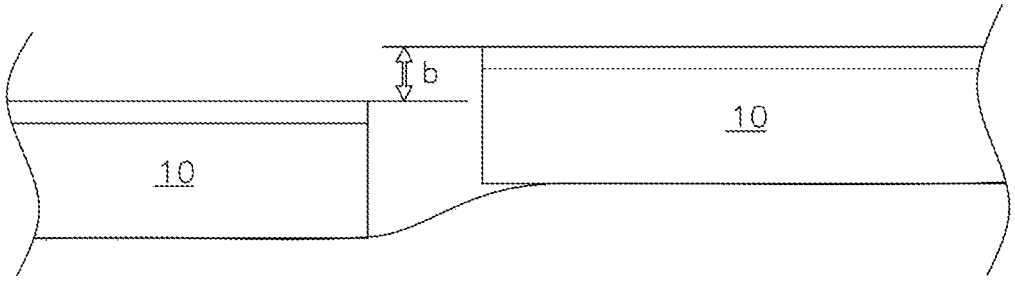
FIG. 7 is a side view illustrating horizontal and vertical clearances of fixed frames generated during construction of fixed frames.
Figure 8:
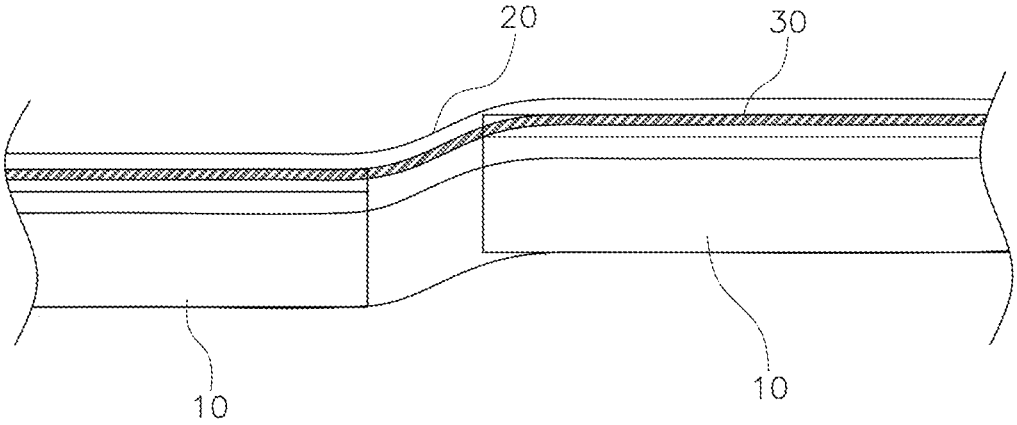
FIG. 8 is a side view illustrating a concept of compensating a vertical clearance of fixed frames according to the present invention.
Figure 10:
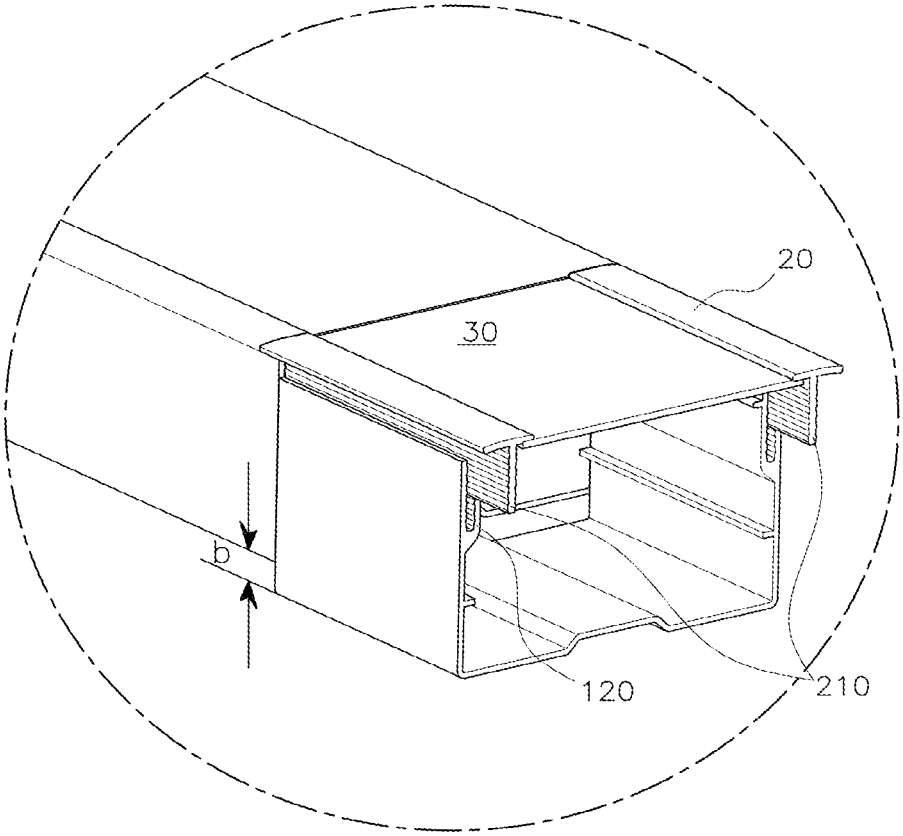
FIG. 10 is a view of constructed fixed frames illustrating a vertical clearance of fixed frames generated in construction of the fixed frames as an example.
Figure 11:
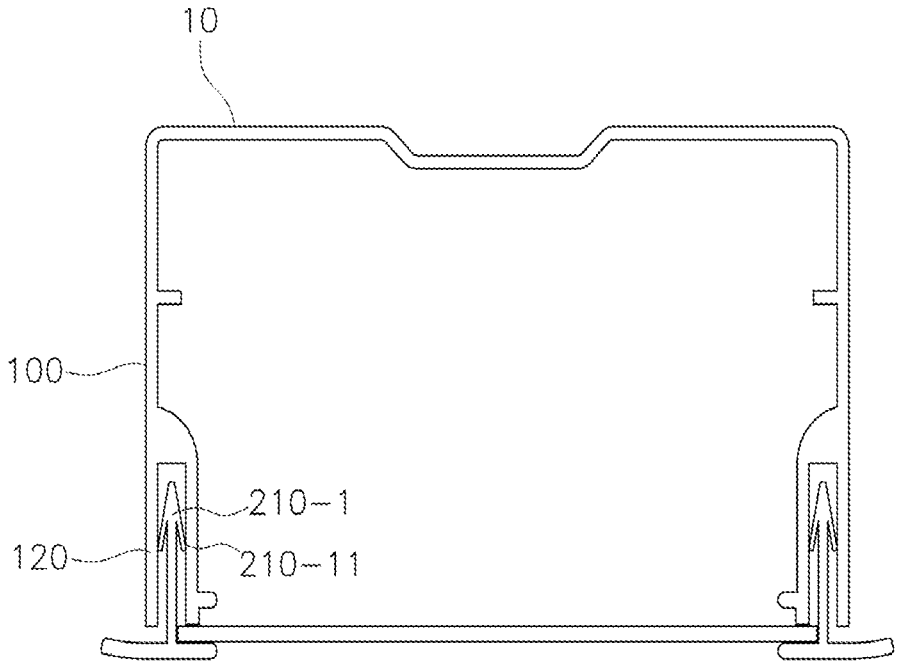
FIG. 11 is a cross sectional view of another embodiment of the present invention.
Figure 12:
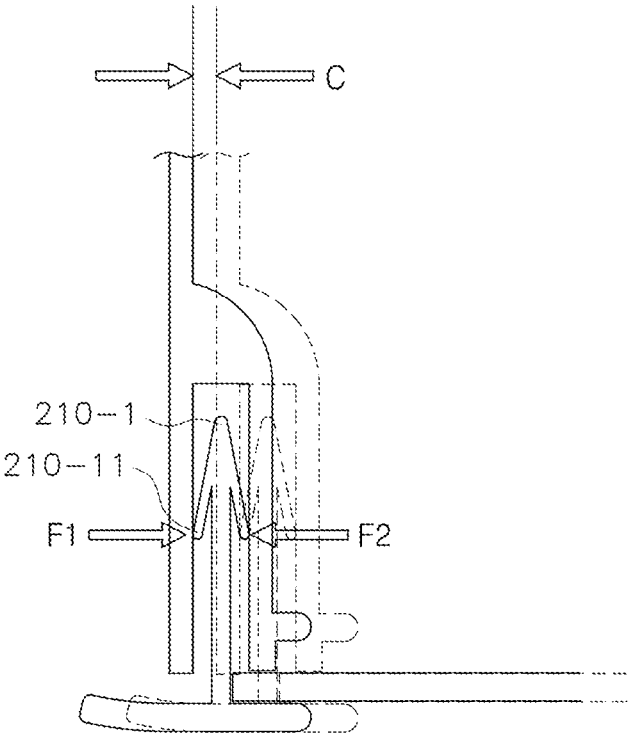
FIG. 12 is a front view illustrating a concept of a linear clearance generated during the construction of a fixed frame and a concept of compensating the linear clearance.
Figure 13:
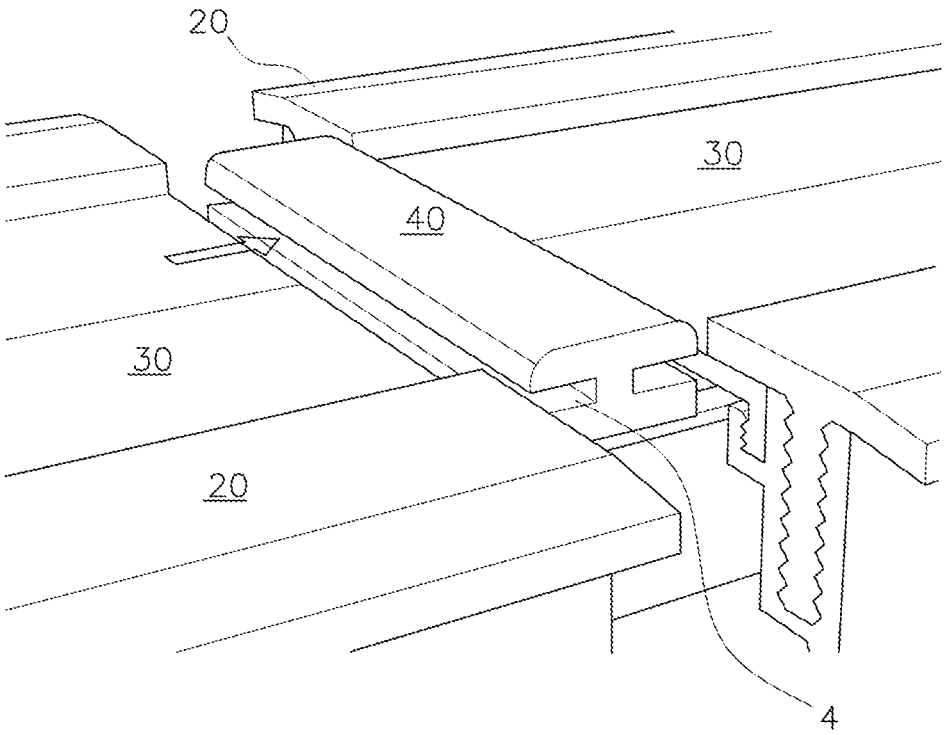
FIG. 13 is a view illustrating an end mold according to the present invention as an example.
Figure 14:
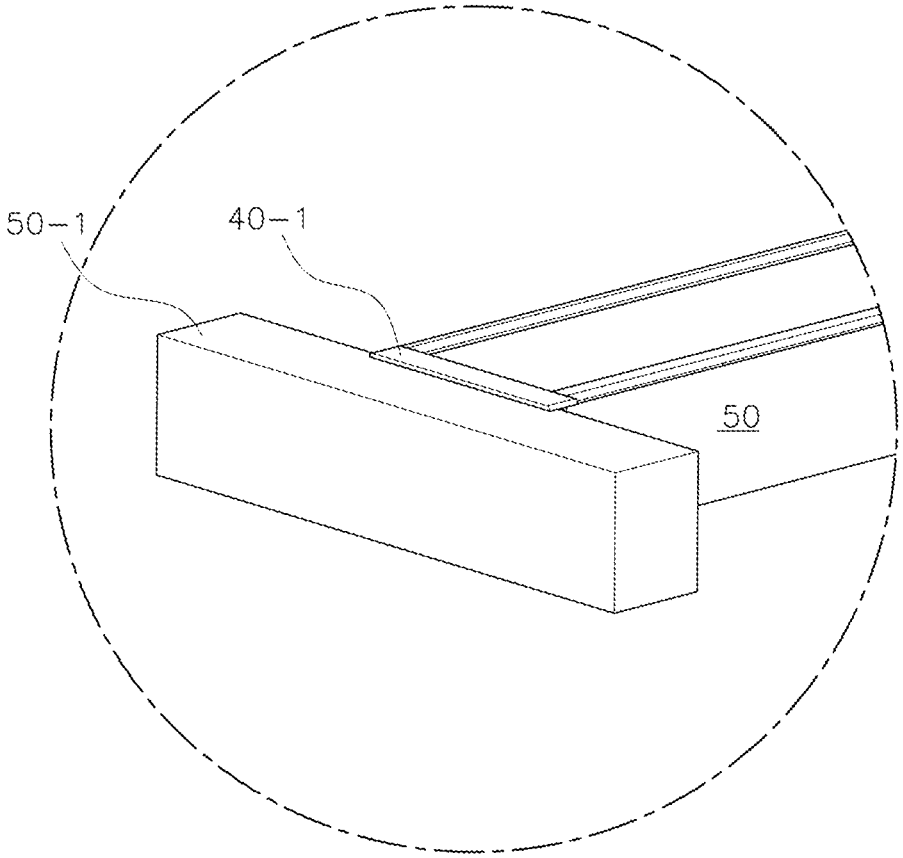
FIG. 14 is a view illustrating a wall mold according to the present invention as an example.
Figure 15:
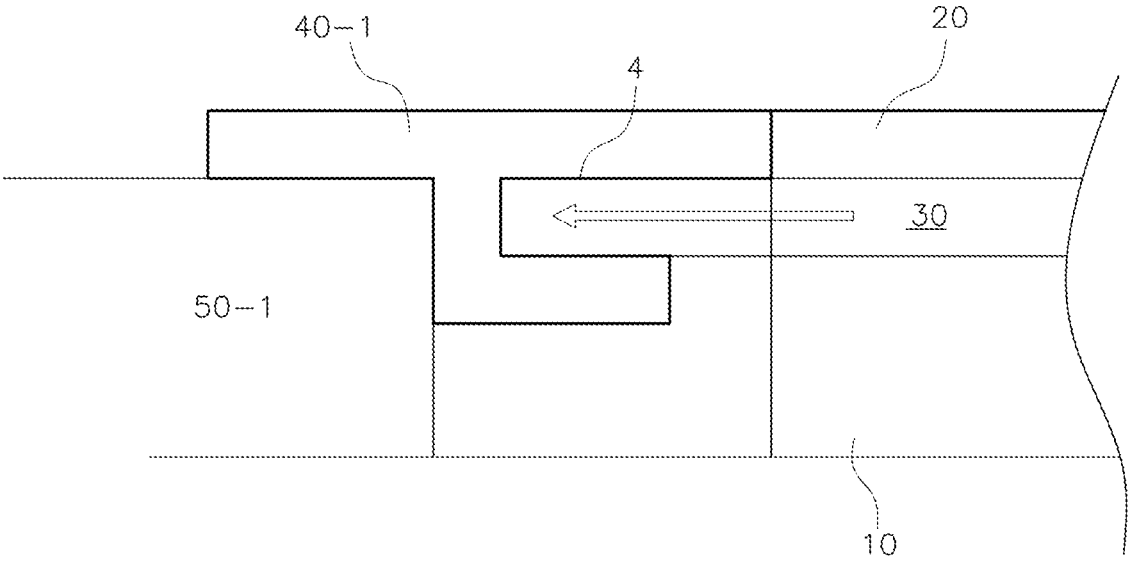
FIG. 15 is a view illustrating a coupling of a wall mold according to the present invention as an example.
Figure 16:
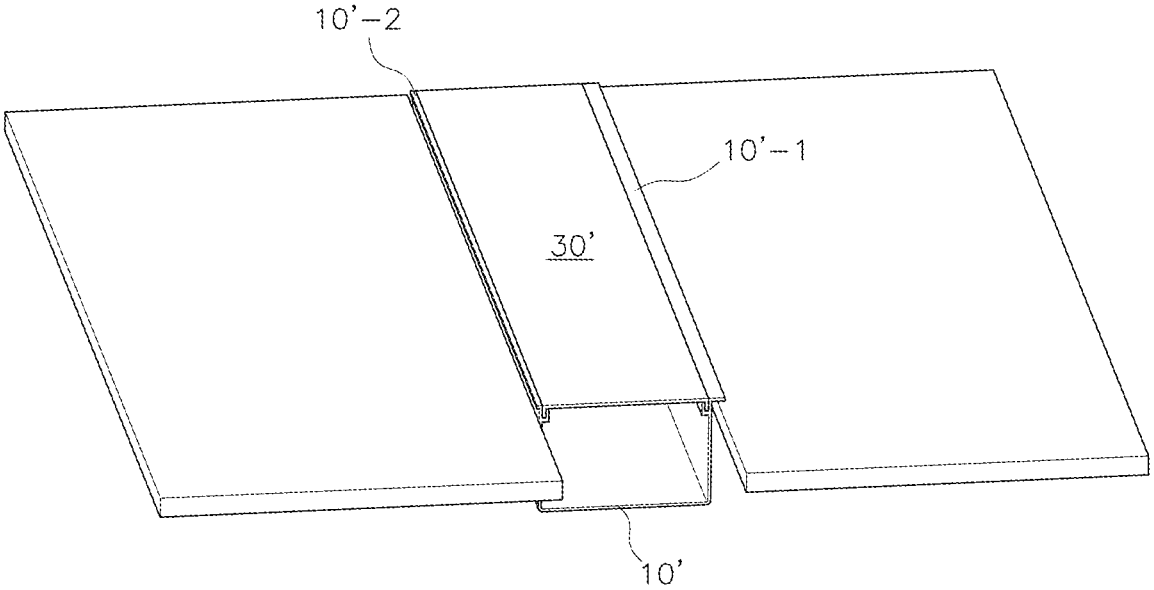
FIG. 16 is a perspective view illustrating each embodiment and construction of a fixed frame according to the conventional art.

FIG. 1 is an assembled perspective view of an embodiment of the present invention; FIG. 2 is an exploded perspective view of an embodiment of the present invention; FIG. 3 is a perspective view after construction of FIG. 2; FIGS. 4A to 4G are each a cross sectional view of each embodiment of the present invention; FIG. 5 is a side view of a horizontal clearance of side structures generated in the construction; FIG. 6 is a plane structural view showing a concept of compensating a horizontal clearance according to the present invention; FIG. 7 is a side structural view of the horizontal and vertical clearances generated during construction of a fixed frame; FIG. 8 is a side structural view showing a concept of compensating a vertical clearance according to the present invention; 9 is a side structural view showing a concept of compensating a vertical clearance according to another embodiment of the present invention; FIG. 10 is a constructional exemplifying view showing a vertical clearance generated in construction of a fixed frame as an example; FIG. 11 is a cross sectional view of another embodiment of the present invention; FIG. 12 is a front structural view showing a concept of a linear clearance generated during the construction of a fixed frame and a concept of compensating the linear clearance; FIG. 13 is an exemplifying view showing an end mold according to the present invention as an example; FIG. 14 is an exemplifying view showing a wall mold according to the present invention as an example; FIG. 15 is a structural view showing a coupling of a wall mold according to the present invention as an example; and FIG. 16 is a view showing each embodiment and a perspective view showing a construction of a fixed frame according to the conventional art.

As illustrated in the drawings, the present invention relates to side molded combination type line lights and is configured largely to include: a fixed frame 10 formed with a pair of opposite side walls 100 each having a protruding locking portion 130 formed thereon, a closing portion 110, and an opening portion; a diffusion plate 30; a pair of side mold coupling ends 120; and a pair of side molds 20 on each of which an engaging portion 210 is formed.

With a reference to FIG. 1, the fixed frame for line lights generally has a basic C-shaped cross sectional structure, the protruding locking portion 130 for guiding the fixation of the pieces is formed on each inner surface of opposite sides of the pair of opposite side walls, the closing portion 110 faces the installation surface which is a ceiling, a wall, or a floor surface, and the opening portion performs a lighting function for emitting light and is installed to face the illumination space.

Accordingly, as illustrated in FIG. 1, the diffusion plate 30 that is connected between end portions of opposite sides of the pair of opposite side walls of the fixed frame 10 and performs a lighting function is well known in the art.

The present invention is characterized in that it includes a side mold 20 which is coupled by press-fitting with each of the end portions of opposite side walls of the fixed frame as illustrated in FIG. 1.

To this end, the side mold coupling end 120 is formed at the each of the end portions of opposite side walls 100 of the fixed frame 10 of the present invention, and the side mold 20 is formed with the engaging portion 210 to be coupled with the side mold coupling end 120. Then, the side mold 20 is coupled to each of the end portions of opposite side walls of the fixed frame 10.

As illustrated in FIGS. 1 and 2, the side mold 20 coupled with each of the end portions of opposite side walls of the fixed frame 10 performs a function of finishing gaps generated due to a vertical clearance 'b', a horizontal clearance 'a', and a linear clearance 'c'.

Since the opposite side walls 100 are buried generally in a constructed surface such as a ceiling or a wall during the installation of the line lights, only the diffusion plate 30 is exposed to perform an illumination function. When the side mold 20 is press-fitted along with the diffusion plate 30 as in the present invention, the side mold 20 covers a buried gap generated in the construction as illustrated in FIG. 3, thereby forming an interior aesthetic sense together with the diffusion plate 30.

The side mold coupling end 120 and the engaging portion 210 have an influence on the construction process of line lights and thus should be installed easily and firmly.

To this end, the present invention is preferable to be formed in the male and female combination structures as illustrated in embodiments illustrated in FIGS. 4A, 4C, 4D, 4F, and 4G.

That is, when the side mold coupling end 120 or the engaging portion 210 is formed in the female combination structure as an engaging holder, the side mold coupling end 120 or the engaging portion 210 to be inserted thereinto correspondingly becomes a male combination structure.

Figure 4C:
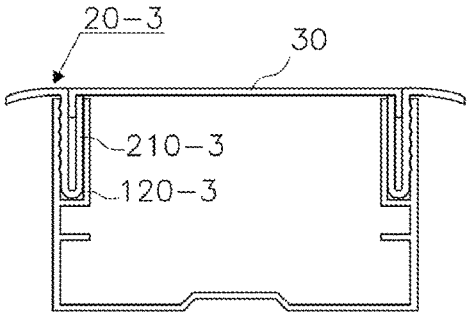
Figure 4D:
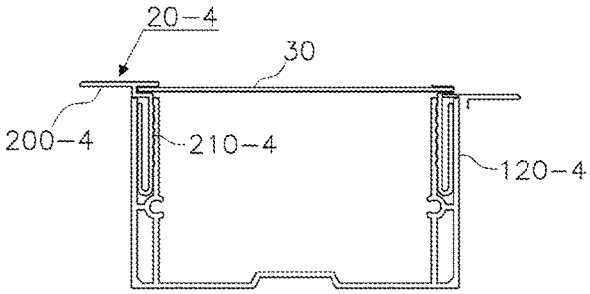

In order to firmly couple the mold coupling end 120 or the engaging portion 210, the present invention may also allow the any male combination structure among the side mold coupling end 120 and the coupling part 210 to be formed in a U-shaped elastic coupling structure as illustrated in FIGS. 4C and 4D.

When the U-shaped elastic coupling structure is inserted into the female combination structure as described above, there is an effect that the inner portion of the female combination structure is elastically pressed by the elastic restoring force after the coupling, and the coupling becomes strong.

Figure 4E:
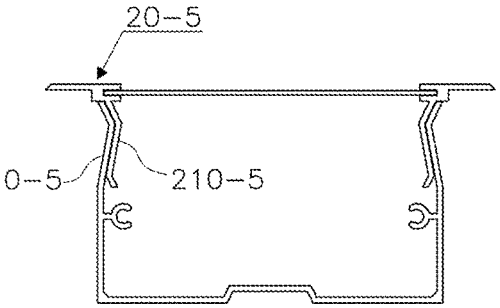

According to another embodiment of the present invention, the side mold coupling end 120 and the engaging portion 210 may be formed in an elastic press-fitting combination structure as illustrated in FIGS. 4B and 4E.

That is, in the case where the side mold coupling end 120 or the engaging portion 210 is formed in a bent portion to be engaged into mutually, it is possible to maintain the coupling by the structure combined by press-fitting by mutual elastic force.

The side mold 20 of the present invention is formed in a frame having a L-shaped or T-shaped cross section as illustrated in each embodiment of FIG. 4 in order to form a wing at each of end portions of the opposite side walls of the fixed frame 10 and may be made of a flexible material for convenience of construction.

Hereinafter, for explaining the present invention, the frame of the L-shaped or T-shaped cross section will be described as being divided into a vertical part and a horizontal part.

As illustrated in FIGS. 4B and 4C, when the side mold is formed into an L shape, the vertical portion thereof becomes the engaging portion, and the horizontal portion thereof becomes the fixed frame appearance forming portion 200.

In addition, when the side mold is formed into a T shape as illustrated in FIGS. 1 to 3, the vertical portion of the center becomes the engaging portion 210, and the horizontal portion becomes the fixed frame appearance forming portion 200.

It is preferable that the side mold coupling end 120 and the engaging portion 210 are formed to be long enough to adjust the insertion depth. In order to adjust the insertion depth, protrusions 211 are formed as illustrated in FIGS. 1 to 3.

It is preferable that the side mold coupling end 120 and the engaging portion 210 are formed to be long so that the insertion depth can be adjusted, and it is preferable to form protrusions 211 in order to adjust the insertion depth as illustrated in FIGS. 1 to 3.

It is preferable that the protrusions 211 are formed to be engaged with each other at the side mold coupling end 120 and the engaging portion 210. However, the protrusions 211 need not necessarily be precisely engaged with each other and are good enough to be in a state where the protrusions 211 can be fixed after adjusting the insertion depth.

In particular, in the case where the side mold 20 is formed into a T shape, the side mold 20 becomes to cover an engaging gap 3 between the diffusion plate 30 and the fixed frame 10 at end portions of opposite side walls of the fixed frame 10.

Accordingly, the T-shaped side mold 20 blocks the light leakage phenomenon whereby the light leaks out through the engaging gap 3 between the diffusion plate 30 and the fixed frame 10 by the horizontal portion thereof, thereby improving the aesthetics of the interior by preventing defect of light leakage after construction.

Generally, the diffusion plate engaging portion 300 is formed at the end portions of opposite side walls 100 of the fixed frame 10. In the present invention, as illustrated in FIGS. 1 to 3, a diffusion plate engaging portion 300 to be coupled to the diffusion plate 30 is formed at each inner surface of the end portions of opposite side walls 100 of the fixed frame 10, and the diffusion plate 30 is engaged with the diffusion plate engaging portion 300. Accordingly, the diffusion plate 30 is engaged with the inner sides of the end portions of opposite side walls 100 of the fixed frame 10. In addition, the T-shaped side mold 20 is coupled to the outer side of the diffusion plate 30 so that the T-shaped side mold 20 covers the outer side of the diffusion plate 30 along the fixed frame 10. Consequently, the light leakage phenomenon is eliminated.

As illustrated in FIG. 1, the light leakage phenomenon is caused by the engaging gap 3 between the diffusion plate 30 and the fixed frame 10, so that the light leakage phenomenon can be prevented by removing the engaging gap 3.

In actuality, the diffusion plate engaging portion 300 is formed in various shapes and is mostly formed parallel to the diffusion plate 30, unlike FIG. 1. In this case, or even in the case of FIG. 1, it is very frequent that the diffusion plate 30 escapes from the diffusion plate engaging portion 300 due to a change in temperature or a cause of the surrounding environment after the construction. Therefore, solving the light leakage problem using the side mold 20 of the present invention solves a big problem in the construction field using line lights.

In the case of the T-shaped side mold 20, the present invention may consider that the diffusion plate engaging portion 300 is formed on the horizontal portion facing the opening of the fixed frame 10 as illustrated in FIGS. 4A and 4B, and the diffusion plate 30 is engaged with the diffusion plate engaging portion 300 to be constrained to the T-shaped side mold 20 to remove the light leakage phenomenon.

In another embodiment of the present invention, the light leakage phenomenon occurring between the diffusion plate 30 and the fixed frame can be blocked even with the L-shaped side mold.

As illustrated in FIG. 4C of an embodiment of the present invention, when the engaging portion of the L-shaped side mold 20 is formed of the U-shaped elastic body and the opening portion thereof is used as the diffusion plate engaging portion 300 of the diffusion plate 30, a coupling gap is not formed directly between the diffusion plate 30 and the fixed frame 10, so that light leakage can be prevented.

As described above, according to the present invention, by forming the side mold 20 at each of the end portions of the opposite side walls of the fixed frame 10, the problem of light leakage is solved.

However, the light leakage phenomenon during the construction of the line lights is not a problem that occurs only through the engaging gap 3 between the diffusion plate 30 and the fixed frame 10.

In this regard, since the length of the fixed frame 10 is formed of metal material such as aluminum or the like, it is supplied as a single unit having a standard length for convenience of construction.

Accordingly, there are many types of construction methods such as cutting the fixed frame 10 along the length thereof, extending fixed frame 10 in a continuous array, or extending fixed frame 10 so as to have an angle to the curved portion at the construction site, and light leakage phenomenon occurs according to the construction type.

For example, when the fixed frames 10 having a standard length are constructed to be continuously arranged, the vertical clearance 'b' (height difference) due to a mismatch of the flatness of the construction surface, the horizontal clearance 'a' (length difference) due to the length error, and a linear clearance 'c' (linear positioning error) caused by a linear construction error (hereinafter, referred to as a "linear error") are generated, and each clearance causes a light leakage.

To describe in detail hereinafter, when the flatness of the construction surface is inconsistent as illustrated in FIG. 7, a vertical clearance 'b' (height difference) is generated in the continuously arranged fixed frames 10. In this case, since a severe light leakage occurs at the contact part, it is necessary to seal off.

According to the present invention, the light leakage phenomenon due to the vertical clearance 'b' can be effectively prevented.

Hereinafter, the construction method of the present invention will be described.

An embodiment of a construction when the vertical clearance 'b' (height difference) is generated due to the flatness error of the construction surface as illustrated in FIG. 7 is as follows.

Step 11 of the construction method of the present invention is a step where two fixed frames 10 are vertically spaced and connected to each other in series on a straight line as illustrated in FIG. 7.

According to the present invention, even if a vertical clearance (height difference) is generated due to a flatness error of a construction surface as in step 11, as illustrated in FIG. 7, the fixed frames 10 can be linearly arranged in series with a vertical clearance 'b' as illustrated in FIG. 7.

The vertical clearance 'b' is a problem that occurs very frequently due to the fact that the length of the line lights is often installed along a very long corridor, is constructed by the complicated design for the interior effect, or the like.

Step 12 of the present invention is a step where the diffusion plate 30 is continuously coupled with the fixed frames 10 in series to allow the arrangement gap between two fixed frames 10 in series constructed with a vertical clearance 'b' to be covered.

In the case of the fixed frame 10, since the fixed frames 10 are formed of aluminum and are supplied by being manufactured in a standard length, the arrangement gap therebetween may be formed. However, since the diffusion plate 30 is formed of a synthetic resin material, it is free from the limit of the standard length.

Accordingly, even when the fixed frames 10 are formed with a vertical clearance b, thereby forming the arrangement gap, the diffusion plate 30 passes over the arrangement gap, and is coupled with the fixed frames 10. As a result, there is no diffusion plate light leakage due to the arrangement gap between two fixed frames 10 in series.

Step 13 of the present invention is a step where the side molds 20 of the present invention are coupled with each other in series to allow the arrangement gap between two fixed frames 10 in series to be covered.

Since the side mold 20 of the present invention can be formed of a synthetic resin material or a soft material in the same manner as the diffusion plate 30, the side mold 20 can be extended regardless of the standard length of the fixed frame 10.

Therefore, when the side mold 20 is coupled with the fixed frames 10 after the diffusion plate 30 is coupled with the fixed frames 10 in step 12, as illustrated in FIG. 8, not only the arrangement gap between the diffusion plate 30 and the fixed frames 10 but also the arrangement gap between the two fixed frames 10 in series is covered. Consequently, it is possible to completely block, at the exterior of the line lights, the light leakage due to the vertical gap b and to enhance the aesthetics of the line lights.

Step 13-1 of the present invention is a step where the depth of the side mold coupling is adjusted so that the vertical gap 'b' between the fixed frames 10 is compensated by the side mold 20 to be horizontally viewed in step 13.

When the side mold coupling end 120 and the engaging portion 210 are formed by the male and female combination structures, the side mold 20 can adjust the height of the side mold 20 by the coupling depth. Therefore, when the depth of the side mold coupling (x1, x2, and x3) are gently adjusted in step 13-1, the vertical clearance 'b' is compensated to appear as an apparent horizontal construction.

At this time, it is preferable to form the protrusions 211 which are mutually engaged with each other or the fixable protrusions 211 to the side mold coupling end 120 and the engaging portion 210 in order to fix the depth of the side mold coupling. Subsequently, the protrusions 211 are fixed by press fitting.

Figure 4F:
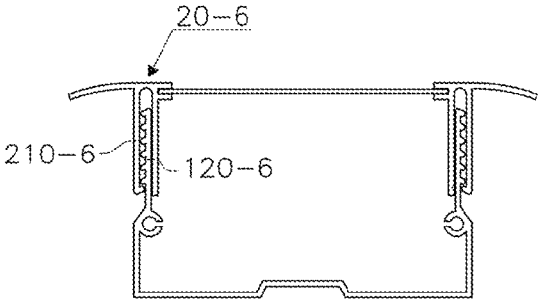
Figure 4G:
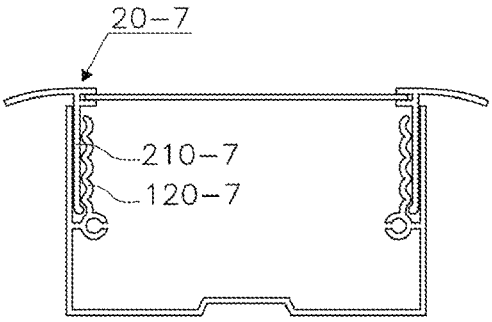

As illustrated in FIGS. 4F and 4G, even when the side mold coupling end 120 and the engaging portion 210 are formed in the elastic press-fitting structures by changing the male and female directions, when protrusion are formed to mutually fix the side mold coupling end 120 and the engaging portion 210, it is possible to adjust the depth of the side mold coupling.

Figure 9:
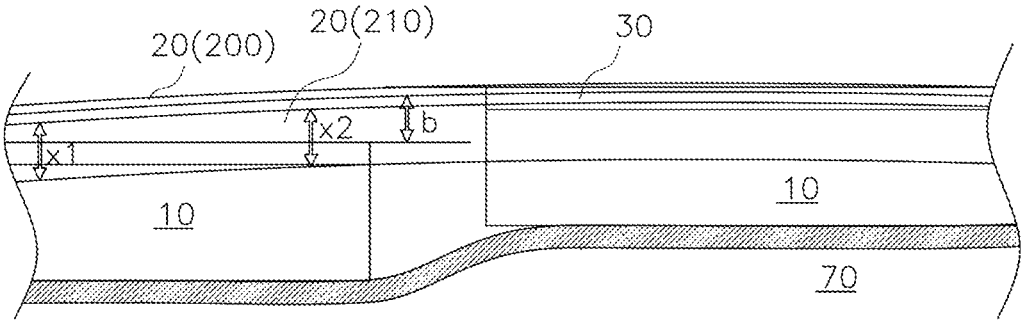
FIG. 9 is a side view illustrating a concept of compensating a vertical clearance of fixed frames according to another embodiment of the present invention.

In the embodiments of FIGS. 7 to 9, the vertical clearance and the horizontal clearance are actually generated together. When only the vertical clearance 'b' is generated as illustrated in FIG. 10, the apparent difference is eliminated by the side mold 20 and the diffusion plate 30, and thus the light leakage problem can be solved.

Hereinafter, in the method of continuous interior lighting construction of the side molded combination type line lights of the present invention, an embodiment of construction for the case that the horizontal clearance 'a' is generated between the two fixed frames 10 arranged in series due to a standard length of the fixed frames 10 as illustrated in FIG. 5 is as follows.

Step 21 is a construction when the horizontal clearance 'a' is generated due to the standard length of the fixed frames 10 during the construction of the present invention and is a step where the two fixed frames 10 are coupled in linear array in series while the horizontal clearance 'a' therebetween is permitted.

Step 22 of the present invention is a step where the diffusion plate 30 is continuously coupled with fixed frames 10 in series to allow the arrangement gap due to a horizontal clearance 'a' between the two fixed frames 10 to be covered.

As described above, the diffusion plate 30 can be produced very long regardless of the standard length of the fixed frames 10, and even can be distributed to the production site as a roll type.

Therefore, it is possible to cover the arrangement gap by coupling the diffusion plate 30 onto the arrangement gap between the two adjacent fixed frames 10 fixed in a state in which the horizontal gap 'a' is allowed therebetween in step 21.

Step 23 of the present invention is a step where the side mold 20 of the present invention is continuously coupled with the fixed frames 10 in series to allow the arrangement gap due to a horizontal clearance 'a' between the two fixed frames 10 to be covered.

As described above, since the side mold 20 of the present invention can also be produced free from the length of the fixed frame 10, it is possible to cover the continuous arrangement gap by coupling the side mold 20 onto the continuous arrangement gap between the two adjacent fixed frames 10 fixed in a state in which the horizontal gap 'a' is allowed therebetween.

According to such a construction method, as illustrated in FIG. 6, the light leakage phenomenon can be eliminated by sealing the continuous arrangement gap, generated at the construction site due to the standard length of the fixed frames 10, with the diffusion plate 30 and the side mold 20.

In one embodiment of the method of continuous interior lighting construction side molded combination type line lights of the present invention, steps 12 and 13, and 22 and 23 correspond to the description of the structure of the embodiment of FIGS. 1 and 2 in which the diffusion plate is constructed prior to the side mold.

However, when the diffusion plate engaging portion 300 is formed in the side mold 20 as in the embodiment of FIG. 4C of the present invention, by changing the order of steps 12 and 13, and then by changing the order of steps 22 and 23, it is possible to achieve the object of the present invention that the light leakage phenomenon is eliminated by sealing the continuous arrangement gap.

In the method of continuous interior lighting construction of the present invention, when the linear clearance 'c' (linear positioning error) caused by a linear construction error is generated as illustrated in FIG. 12, an embodiment of construction is as follows.

Step 31 of the present invention corresponds to a case where the two fixed frames 10 arranged in series are coupled with each other and a construction error in a successive arrangement of the two fixed frames 10 causes a generation of a linear clearance 'c'.

That is, step 31 is a case where a linear clearance is found when the fixed frames are constructed in a successive arrangement.

As illustrated in FIG. 1, since the fixed frame 10 is constructed by connecting pieces positioned opposite to each other to the protruding locking portion 130, the linear clearance 'c' is generated very frequently due to such a construction method.

Step 32 of the present invention is a step where the diffusion plate 30 is continuously coupled with the two fixed frames 10, thereby allowing the arrangement gap due to the horizontal clearance 'a' of the opening of the fixed frames 10 to be covered.

In this case, step 32 can be done only when the shape of the diffusion plate engaging portion 300 is formed parallel to the diffusion plate 30 and formed deeply.

Step 33 of the present invention is a step where the side mold 20 of arrow-shaped elastic coupling structure as illustrated in FIGS. 11 and 12 is continuously coupled with the two fixed frames 10, thereby allowing the array clearances due to the linear clearance 'c' of opposite side walls to be covered.

As illustrated in FIGS. 11 and 12, the engaging portion 210-1 of the arrow shaped cross section is formed in the side mold 20 of the arrow-shaped elastic-coupling structure, and the inclined wing 210-11 is formed at the end portion thereof.

In step 33, when the side mold 20 of FIG. 1 is used, the side mold 20 formed of a soft material may also be coupled as the engaging portion 210 is bent, but the present invention facilitates the absorption of the linear clearance 'c' as shown in FIG. 12 by adding the side mold 20 of the arrow-shaped elastic coupling structure.

In FIG. 12, the inclined wing 210-11 has a function of maintaining the engagement. In addition, when the side mold coupling end 120 is subjected to a force F1 or F2 due to the linear clearance c, the inclined wing 210-11 is folded and accommodates the force, thereby being more easily coupled to the portion of the linear clearance 'c' than the side mold of FIG. 1.

Meanwhile, as illustrated in FIG. 13, the present invention is configured to further include an end mold 40 that is a structure having H cross section formed with diffusion plate insertion grooves 4 at opposite sides thereof, is formed in a length equal to the width of the fixed frame 10 in which the side mold 20 is inserted, and is inserted to the diffusion plate 30 at each of end portions of the fixed frames 10 formed in a standard length.

According to the end mold 40, when a problem such as the horizontal clearance 'a' or the like occurs during the unit fixed frames 10 are continuously arranged, and the diffusion plate 30 cannot be continuously coupled therewith for whatever reason, the problem of light leakage can be solved by inserting the end mold 40.

Further, the end mold 40 is useful not only for the continuous array between the unit fixed frames 10 but also for the finishing treatment of the fixed frame 10 and the wall 50-1 of the final construction portion as illustrated in FIG. 14.

That is, in the final construction portion, the electric wire or the like connected to the inside of the fixed frame 10 is connected thereto by separating the fixed frame 10 from the wall, so that the inside of the fixed frame 10 can be exposed to the outside. In this case, the end mold 40 has an effect of covering the exposure of the inside of the fixed frame 10.

For this purpose, as illustrated in FIG. 15, a wall mold 40-1 of a structure having an h cross section may be formed by allowing the end mold 40 of the structure having H cross section to have the diffusion plate insertion groove 4 only in one side thereof.

As illustrated in FIG. 15, when the wall mold 40-1 is inserted between the wall 50-1 and the fixed frame 10, and then the diffusion plate 30 is extended and inserted into the diffusion plate insertion groove 4, a construction appearance becomes as illustrated in FIG. 14. Accordingly, it is possible to complete the construction between the wall and the fixed frame.

According to the present invention configured as described above, the side molds 20 of various sizes can be coupled with the end portions of the opposite side walls 100 of the fixed frame 10 according to the interior design by using the side molds 20 independent of the fixed frame 10. Accordingly, it is possible to simplify the standard of the fixed frame 10 and complete the various interiors by simply changing the type of the side molds 20. Therefore, the problem of the conventional method of producing the fixed frame 10 in various sizes can be solved.

The drawings illustrated to describe the present invention are illustrative purpose only for the realization of the present invention, and it will be appreciated that various combinations of features are possible to achieve the spirit of the invention as illustrated in the drawings.

Accordingly, it will be understood by those skilled in the art that the scope of the present invention is not limited thereto, and various changes in form and details may be made therein without departing from the spirit and scope of the invention as defined in the appended claims and their equivalents.

What is claimed is:

1. Line lights, comprising:

a fixed frame having a C-shaped cross sectional structure formed with a closing portion, opposite side walls, and an opening portion, wherein a protruding locking portion for guiding fixation of pieces is formed on inner side of the opposite side walls, and a side mold coupling end is formed at each of the end portions of the opposite side walls;

a diffusion plate coupled with the opening portion of the fixed frame; and a pair of side molds each having an L-shaped or T-shaped cross section, wherein an engaging portion is formed on each of the side molds and coupled with each of the end portions of the opposite side walls of the fixed frame, wherein each of the side mold coupling ends and the engaging portions includes protrusions formed therein, the protrusions configured to adjust an insertion depth of the side molds relative to the end portions of the opposite side walls.

2. The lights of claim 1, wherein the side mold coupling end and the engaging portion have male and female combination structures.

3. The lights of claim 2, wherein any male combination structure among the side mold coupling end and the coupling part is formed in a U-shaped elastic coupling structure or an arrow-shaped elastic coupling structure and coupled inside the female combination structure, thereby elastically pressing the inner side of the female combination structure.

4. The lights of claim 1, wherein the T-shaped side mold coupling end is characterized such that a vertical portion thereof becomes the engaging portion to be coupled with the side mold coupling end, and when the engaging portion is coupled with the side mold coupling end, a horizontal portion thereof covers a coupling gap between the diffusion plate and the fixed frame, thereby preventing light leakage and covers a gap between the fixed frame and a buried wall, thereby forming an aesthetic appearance.

5. The lights of claim 1, wherein a diffusion plate engaging portion is formed at the opening portion of the fixed frame, and the diffusion plate is engaged with the diffusion plate engaging portion, and wherein the side mold is characterized to allow a light leakage to be prevented when the side mold is coupled with the fixed frame.

6. The lights of claim 1, further comprising an end mold having an H cross sectional structure formed with diffusion plate insertion grooves at opposite sides thereof symmetrically, wherein the end mold is inserted between end portions of adjacent fixed frames that are formed in a standard length and constructed and finishes a gap between the end portions of the adjacent fixed frames by inserting adjacent diffusion plates into the diffusion plate insertion grooves.

7. The lights of claim 1, further comprising a wall mold having an h cross sectional structure formed with a diffusion plate insertion groove at one side thereof, wherein the wall mold is inserted between end portion of a fixed frame constructed first from a wall and the wall and finishes a gap between the end portion of the fixed frame and the wall by inserting a diffusion plate into the diffusion plate insertion groove.

* * * * *